US010863870B2

(12) United States Patent
Hart

(10) Patent No.: US 10,863,870 B2
(45) Date of Patent: Dec. 15, 2020

(54) PORTABLE SHOWER APPARATUS

(71) Applicant: Echcho Maria Hart, Miramar, FL (US)

(72) Inventor: Echcho Maria Hart, Miramar, FL (US)

( * ) Notice: Subject to any disclaimer, the term of this patent is extended or adjusted under 35 U.S.C. 154(b) by 0 days.

(21) Appl. No.: 16/121,725

(22) Filed: Sep. 5, 2018

(65) Prior Publication Data

US 2020/0069115 A1 Mar. 5, 2020

(51) Int. Cl.
*A47K 3/32* (2006.01)

(52) U.S. Cl.
CPC ..... *A47K 3/325* (2013.01)

(58) Field of Classification Search
CPC ..... A47K 3/325; A47K 3/286; A47K 3/32; A47K 3/288
USPC ..... 4/603
See application file for complete search history.

(56) References Cited

U.S. PATENT DOCUMENTS 3,067,434 A * 12/1962 Neal ..... A47K 3/325 4/598

* cited by examiner

*Primary Examiner* — Lauren A Crane
(74) *Attorney, Agent, or Firm* — Mark C. Johnson; Johnson Dalal

(57) ABSTRACT

A portable shower device is provided having a housing comprised of an upper portion and a lower portion. The upper portion of the housing is preferably pivotally attached to the lower portion of the housing by a hinge or the like so that the upper portion may be selectively pivotable from either an open position or a closed position. The upper portion includes a channel and a spout to receive and expel liquid, respectively. The lower portion of the housing has a generally hollow interior and an outlet adapted to direct liquid to outside the housing. The housing can include a wheel assembly to facilitate movement of the portable shower. The portable shower can further include a base portion that is formed on or fixedly secured to the housing adjacent to the lower portion. The base portion may be generally hollow and may have an inlet, a conduit, a pump, a nozzle, and one or more electrical connections. The conduit is adapted to direct liquid received from the inlet to the channel of the upper portion of the housing. The inlet, the channel, the conduit, and the spout may be in communication with one another so as to define a passage for liquid to travel therethrough.

22 Claims, 11 Drawing Sheets

PORTABLE SHOWER APPARATUS

FIELD OF INVENTION

The invention relates generally to showering and bathing devices and in particular to a portable shower apparatus.

BACKGROUND OF THE INVENTION

Maintaining personal hygiene, while necessary, may often times prove challenging and complex. For example, when participating in outdoor activities, there may be no public facilities available to individuals that want to bathe. Further, certain individuals may need assistance when using a bath tub or shower. This could be due to many factors. Most common are individuals with illnesses or disabilities who do not have the capability or capacity to shower by themselves, or do not have the proper structures in place to allow them to safely bathe.

In the healthcare industry, it is often difficult to assist patients with hygiene maintenance due to their health issues or disabilities. For instance, healthcare professionals often have to bathe their patients, but may have to move their patients to off-site showering facilities if the bath tub or shower that is currently available to them is neither suitable nor safe to use due to the patient's underlying health conditions or disabilities. Specifically, in-home healthcare professionals are often expected to bathe their patients. While bath tubs and showers that include handicap accessible qualities may be integrated into the patient's home, they are often expensive and require time consuming bathroom renovations.

Most of the portable showers marketed today are merely buckets or small water reservoirs the size of an average backpack that families can take on camping or beach trips. These portable showers have a hose extending from the bucket or reservoir to spray water on the user. These showers provide no privacy and they are susceptible to quickly expend water due to the small amount of water they may hold. In addition, these devices are either heavy to carry due to the weight of the water, or they are difficult to disassemble and reassemble.

There are some instances of portable showers that are designed to provide more privacy; however, these showers are fabricated from non-durable materials such as mesh and synthetic fabrics, and are susceptible to ripping and tearing. Further, when used outside, these materials may be affected by weather occurrences such as wind, rain, show, etc. Additionally, these types of portable shower still require use of a bucket device or some sort of water reservoir to distribute water onto a user's body.

Accordingly, the current invention aims to provide a portable shower device that is easily mobile from location to location, provides privacy, and provides additional features that would be useful to those with handicaps or illnesses.

SUMMARY OF THE INVENTION

The following summary is provided to introduce a selection of concepts in a simplified form that are further described below in the detailed description. This summary is not intended to identify key features or essential features of the claimed subject matter, nor is it intended to be used to limit the scope of the claimed subject matter.

According to one implementation, the portable shower may have a housing comprised of an upper portion and a lower portion. The upper portion of the housing is preferably pivotally attached to the lower portion of the housing. The upper portion of the housing is pivotally attached by a hinge or the like so that the upper portion may be selectively pivotable from either an open position or a closed position. In the open position, the upper portion of the housing is positioned perpendicular to the lower portion of the housing. In the closed position, the upper portion is positioned parallel and adjacent to the lower portion in sealing contact with the lower portion.

The upper portion includes a channel and a spout to receive and expel liquid, respectively. The channel and the spout may be in communication with one another so as to define a passage for liquid to travel therethrough. The lower portion of the housing has a generally hollow interior and an outlet adapted to direct liquid to outside the housing. The outlet may receive liquid expelled from the spout (or any other liquid source that causes liquid to enter the hollow interior of the lower portion), and subsequently directs the liquid to outside the housing.

The housing can include a wheel assembly to facilitate movement of the portable shower. The portable shower can further include a base portion that is formed on or fixedly secured to the housing adjacent to the lower portion. The base portion may be generally hollow and may have an inlet, a conduit, a pump, a nozzle, and one or more electrical connections.

The inlet of the base portion is adapted to receive liquid from a liquid source outside the base portion and direct the liquid to the conduit. The conduit is adapted to direct liquid received from the inlet to the channel of the upper portion of the housing. The inlet, the channel, the conduit, and the spout may be in communication with one another so as to define a passage for liquid to travel therethrough. The pump may be positioned near the inlet and adapted to draw liquid through the inlet into the conduit, and subsequently upstream through the channel and out the spout for expulsion. Upon the liquid being expelled from the spout, the outlet may subsequently direct the liquid to outside the housing. In a preferred implementation, the outlet may be in communication with a nozzle positioned at the base portion so as to form a duct for liquid to travel downstream therethrough and subsequently exit the housing.

Although the invention is illustrated and described herein as embodied in a portable shower device, it is nevertheless not intended to be limited to only the details shown, since various modifications and structural changes may be made therein without departing from the spirit of the invention and within the scope and range of equivalents of the claims.

These and other features and advantages will be apparent from a reading of the following detailed description, and a review of the appended drawings. It is to be understood that the foregoing summary, the following detailed descriptions, and the appended drawings are only explanatory and are not restrictive of various aspects claimed.

DETAILED DESCRIPTION OF THE INVENTION

Figure 1A:
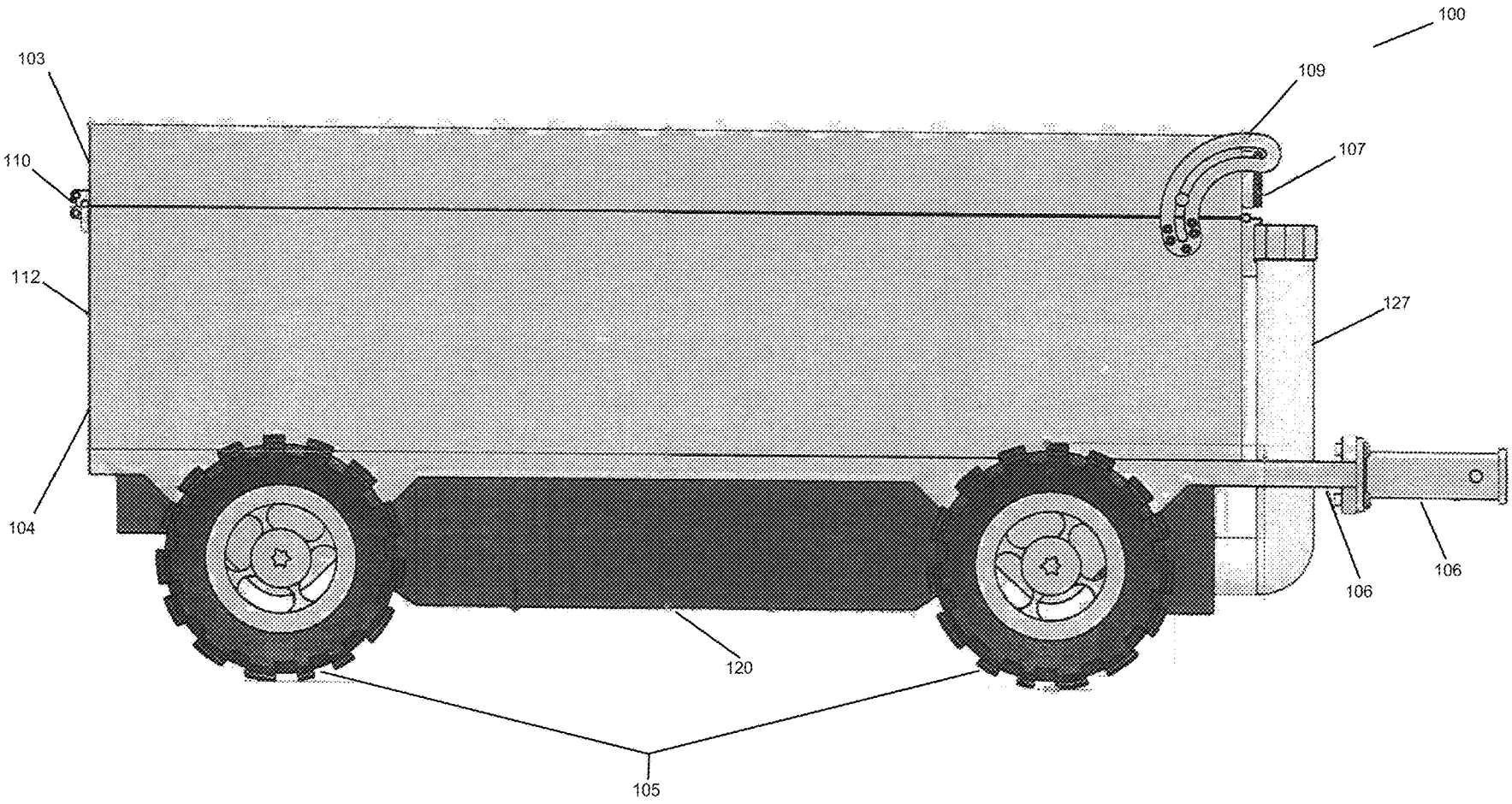
FIGS. 1A-1B are a side view and a rear perspective view, respectively, of the portable shower device in accordance with an implementation of the invention.

Implementations of the invention provide a bathing and showering device that is portable, accessible to various types of individuals, and provides privacy while being used.

Referring to FIGS. 1A-1E, an example implementation of a portable shower 100 includes a housing 102 having an upper portion 103 and a lower portion 104. The frame of the housing 102 can be substantially rectangular; however, the housing 102 is not limited to any particular shape, and may be rectangular, square, or rounded, among other shapes and variations. The entirety or portions of the housing 102 may be fabricated from a rigid material such as fiberglass, plastic, metal, or the like. The housing 102 may be fabricated from popular bathtub materials such as porcelain enameled steel, acrylic, cast polymer, enameled cast iron, or the like. In a preferred implementation, the housing 102 is fabricated from a rust-proof material, for example, a metal alloy such as stainless steel. In another implementation, the housing may further include an anti-microbial and/or anti-bacterial coating.

In one implementation, the housing 102 can include a wheel assembly 105 to facilitate movement of the portable shower 100. The wheel assembly 105 may be comprised of one or more structures that can facilitate the propulsion of the portable shower 100. The wheel assembly 105 is preferably adjacent to the lower portion 104 and the base portion 120 (described in further detail below). The wheel assembly 105 is preferably disposed to support the housing 102 on the ground (or other surface), such that the entire housing 102 is supported on the wheel assembly 105 in at least minimally spaced relation above the ground or other surface over which the portable shower 100 is intended to travel. Further, the wheel assembly 105 is preferably disposed to ensure that the housing 102 is positioned in a level orientation in relation to the ground such that the housing 102 remains parallel to the ground. In one implementation, as shown in FIG. 1A, the portable shower 100 may have the following dimensions: the height from the ground to the top of the upper portion 103 may be 24.81 inches; the height from the ground to the top of the wheel assembly may be 12.94 inches; and the height of ground clearance from the ground to the base portion 120 may be 4.07 inches.

The wheel assembly 105 may take a variety of configurations including one or more wheels, or one or more continuous tracks (e.g. caterpillar track) rotatably mounted on or adjacent to the housing 102. The one or more wheels of the wheel assembly 105 may be all-terrain wheels to permit the portable shower 100 to be transportable in various ground surface conditions, such as rain, snow, sand, mud, inclines, declines, mountainous terrain, etc.

In an additional implementation, the housing 102 may further include a coupler 106, which may be either fixedly or movably mounted onto an exterior portion of the housing 102, such as the lower portion 104 of the housing 102, in order to facilitate the transport or movement of the portable shower 100 over the ground. In a preferred implementation, the coupler 106 is fabricated of a rigid material (such as those described above with respect to the housing 102) and is fixed to the housing 102 by a peripheral bracket 106' that is mounted on or integral to an exterior portion of the housing 102, wherein the coupler 106 extends from the bracket 106'. The coupler 106 is preferably disposed and adapted to connect to an external transport vehicle in order to assist with transporting of the portable shower 100 to a desired location. For example, the coupler 106 may be a hitch that can attach to a truck or other suitable vehicle. In another implementation, an individual can manually grip and pull the on the bracket 106' to transport the portable shower 100.

FIGS. 1A-1E shows various views of the portable shower 100 having a housing 102 comprised of an upper portion 103 and a lower portion 104. The upper portion 103 and the lower portion 104 of the housing 102 preferably have equal lengths and widths so that the housing 102 forms one unitary body when the portable shower 100 is in the closed position (described in greater detail below). In one implementation, as shown in FIG. 1A, the portable shower 100 may have the following dimensions: the upper portion of the housing 102 may be 60 inches in length, and the lower portion of the housing 102 may be 60 inches in length and 12.7 inches in height.

The upper portion 103 of the housing 102 is preferably pivotally attached to the lower portion 104 of the housing 102 at the exterior of the lower portion 104. However, the upper portion 103 may be pivotally attached at the interior of the lower portion 104. The upper portion 103 of the housing 102 is pivotally attached by a hinge 109 or the like so that the upper portion 103 may be selectively pivotable from either an open position (as shown in FIG. 1C) or a closed position (as shown in FIG. 1D). In the open position, the upper portion 103 of the housing 102 is positioned perpendicular to the lower portion 104 of the housing 102. In the closed position, the upper portion 103 is positioned parallel and adjacent to the lower portion 104 in sealing contact with the lower portion 104. In one implementation, in the closed position, the upper portion 103 and the lower portion 104 create a liquid-tight seal that restricts any liquid from exiting or entering the lower portion 104.

The hinge 109 may be adapted to include a catch or the like for maintaining the upper portion 103 in either the open position or the closed position. Preferably, the catch would be utilized to temporarily maintain the upper portion 103 in the open position so that a user cannot inadvertently force the upper portion 103 into the closed position. In another implementation, the catch may be used to maintain the upper portion 103 into the closed position so that a user cannot pivot the upper portion 103 without releasing the catch. In an additional implementation, one or more locks 110 may be included on the exterior surfaces of the upper portion 103 and lower portion 104 of the housing 102. The one or more locks 110 may be used to maintain the upper portion 103 in the closed position so that a user cannot pivot the upper portion 103 without unlocking the one or more locks 110. In an alternative implementation, in the open position, the upper portion 103 of the housing 102 may be angled more than 90 degrees relative to the lower portion 104, so that the natural weight of the upper portion 103 would maintain the upper portion 103 in the open position without the use of a catch.

Figure 1B:
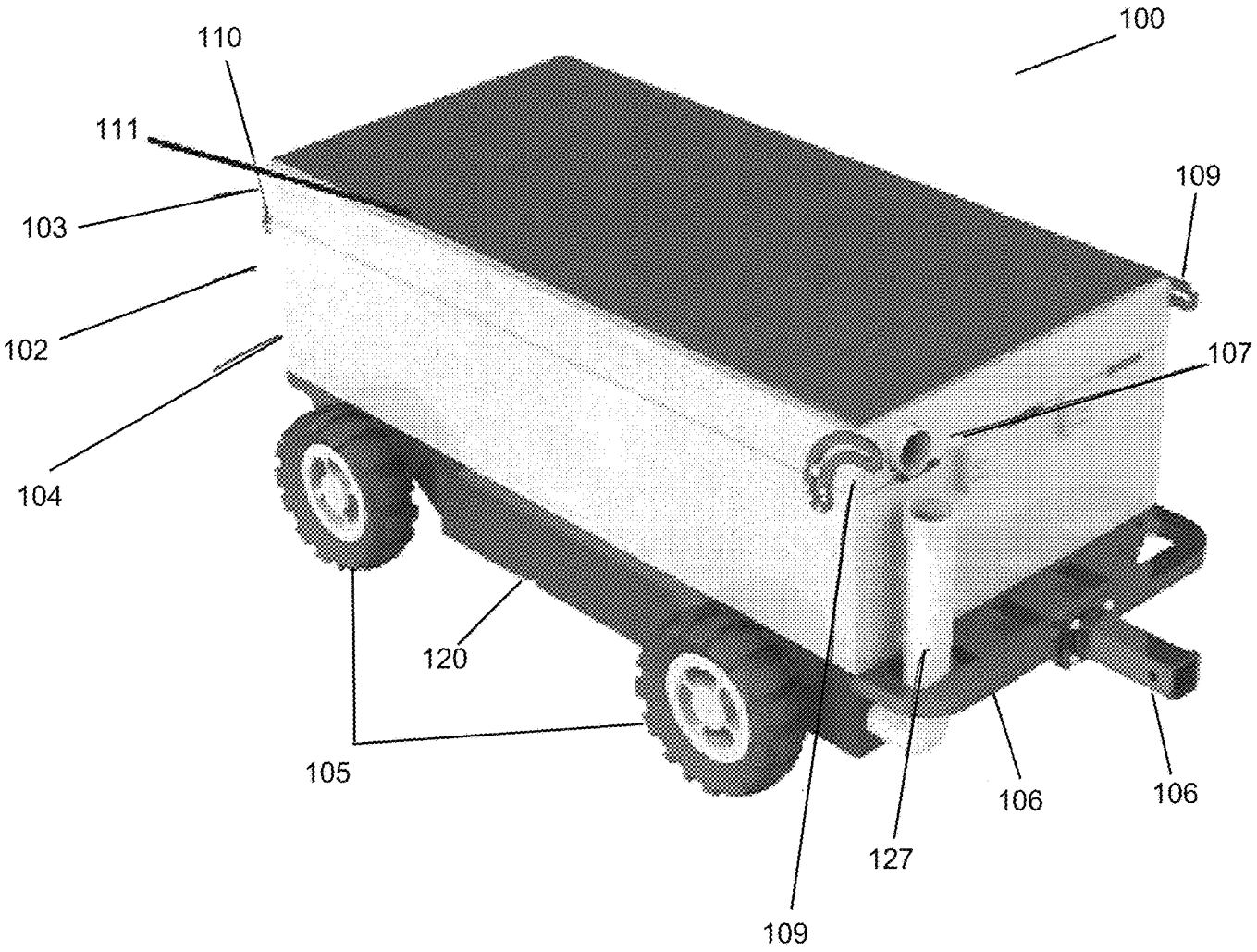
Figure 1C:
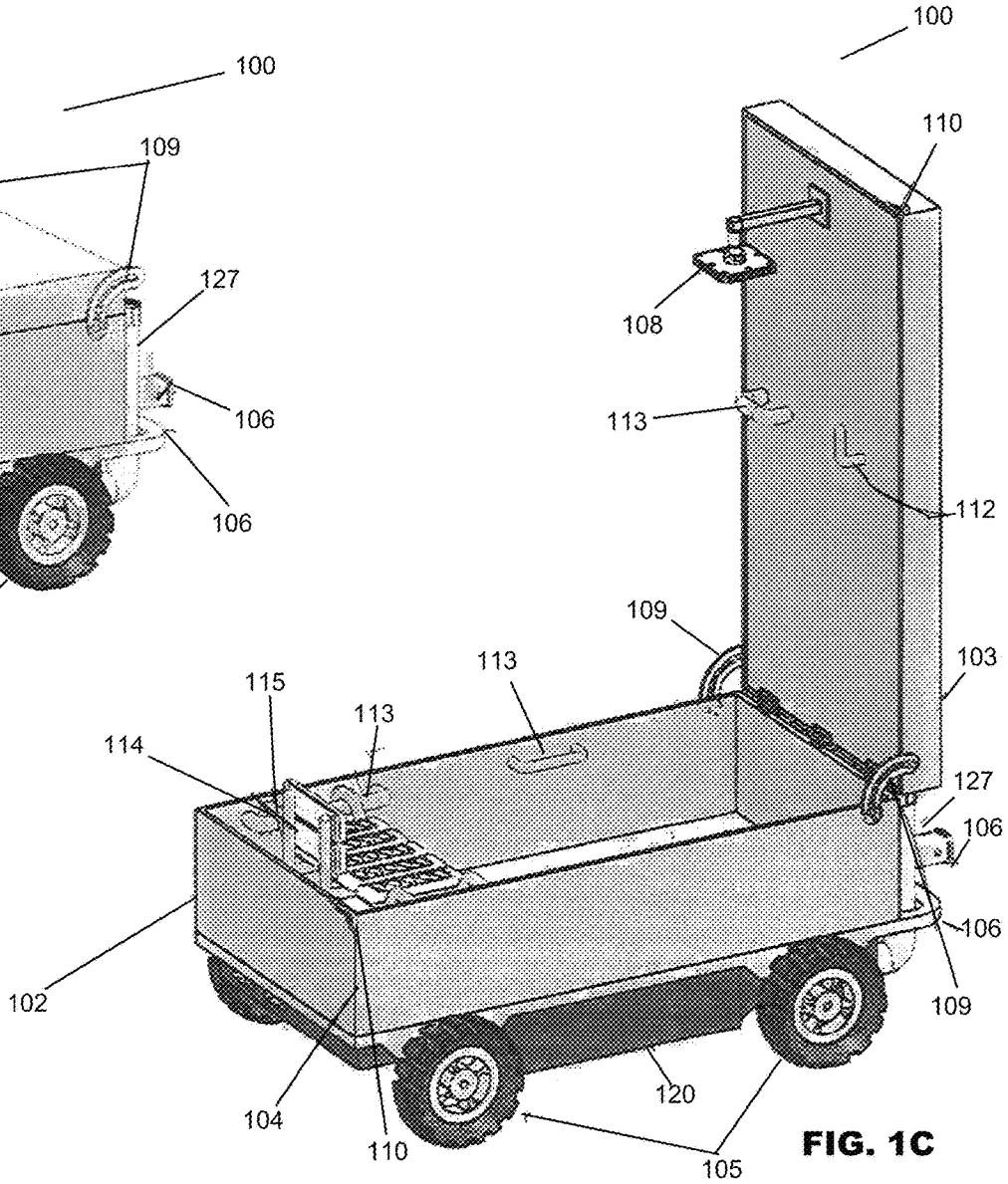
FIGS. 1C-1D are perspective views of the portable shower device in the open position and the closed position, respectively, in accordance with an implementation of the invention.
Figure 1D:
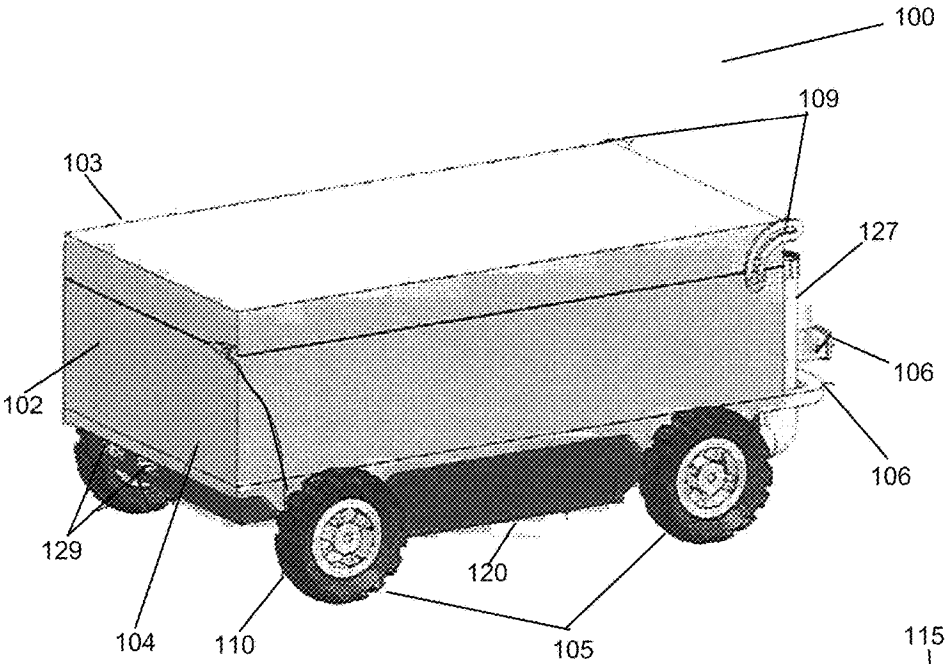

Referring to FIGS. 1A-1C, the upper portion 103 includes a channel 107 and a spout 108 (shown in FIG. 1C) to receive and expel liquid, respectively. The channel 107 and the spout 108 may be in communication with one another so as to define a passage for liquid to travel therethrough. For example, the channel 107 may be a pipe, tube, or the like that directs liquid received from a liquid source to the spout 108 for expulsion. The spout 108 may extend distally from an interior surface of the upper portion 103. The spout 108 may be an orifice having one or more apertures in which liquid may be expelled. For example, the spout 108 may be further connected to or integrated with a shower head, a faucet, or the like. As a further example, the spout 108 may be connected to or integrated with a shower head that has various settings to control the flow and rate of liquid expulsion. Although the exemplary implementation shown in FIG. 1C shows only one spout 108, the upper portion 103 can include one or more spouts 108. For example, the upper portion 103 may include both a shower head and a faucet.

In another implementation, as shown in FIG. 1B, one or more solar panels 111 may be fixedly or removeably attached to the exterior surface of the upper portion 103. The one or more solar panels 111 may be used to provide power to the portable shower 100 (explained in greater detail below), or to heat liquid as it passes through the channel 107 and the spout 108. In a further implementation, the interior surface of the upper portion 103 may also include one or more hangers 112 and/or one or more handles 113, wherein a wash cloth, towel, or the like may be hanged or a user may support their weight upon while using the portable shower 100. Further, the interior surface of the upper portion 103 may also include a caddy to hold common bathroom items such as soap, shampoo, conditioner, or the like.

Referring to FIG. 1C, the lower portion 104 of the housing 102 has a generally hollow interior and an outlet (not shown) adapted to direct liquid to outside the housing 102. The interior of the lower portion 104 may be generally hollow to permit an individual or animal to be situated inside the housing for bathing, showering, or washing. An interior surface of the lower portion 104 may also include one or more hangers or one or more handles 113, wherein a towel may be hanged or a user may support their weight upon while using the portable shower 100. Further, the interior surface of the lower portion 104 may also include a caddy to hold common bathroom items such as soap, shampoo, conditioner, or the like.

In one implementation, the lower portion 104 may also include a removable chair 114. The chair 114 may include one or more hooks 115 that attach on to the one or more handles 113 to support the chair 114 and prevent it from moving. An individual can utilize this chair 114 to sit on, to support their weight, or to place objects on while the portable shower 100 is in use. The chair 114 may be constructed of a rigid, easy to clean material. The chair 114 may have a metal frame, such as aluminum or stainless steel, and the chair 114 may be lightweight, durable, and corrosion proof. The chair 114 may also be height adjustable.

Referring back to FIG. 1C, the outlet (not shown) may be a drain having one or more apertures that receives liquid expelled from the spout 108 (or any other liquid source that causes liquid to enter the hollow interior of the lower portion 104), and subsequently directs the liquid to outside the housing 102. The outlet may be positioned at a floor of the lower portion 104. The floor of the lower portion 104 is the bottommost interior surface of the lower portion 104. The floor of the lower portion 104 may be constructed of non-slip materials to prevent an individual from slipping when getting into or out of the lower portion 204.

In another implementation, the lower portion 104 may include one or more outlets, which may positioned at the floor of the lower portion 104, or about the periphery of the lower portion 104, or any suitable position that would allow the direction of liquid to outside the housing 102. In a preferred implementation, the outlet may be in communication with a nozzle positioned at a base portion (explained in greater detail with respect to FIG. 1E) so as to form a duct for liquid to travel therethrough and exit the housing 102. In a further implementation, the outlet may also include one or more filters to prevent solids from clogging the outlet, the nozzle, or the duct formed therebetween.

Figure 1E:
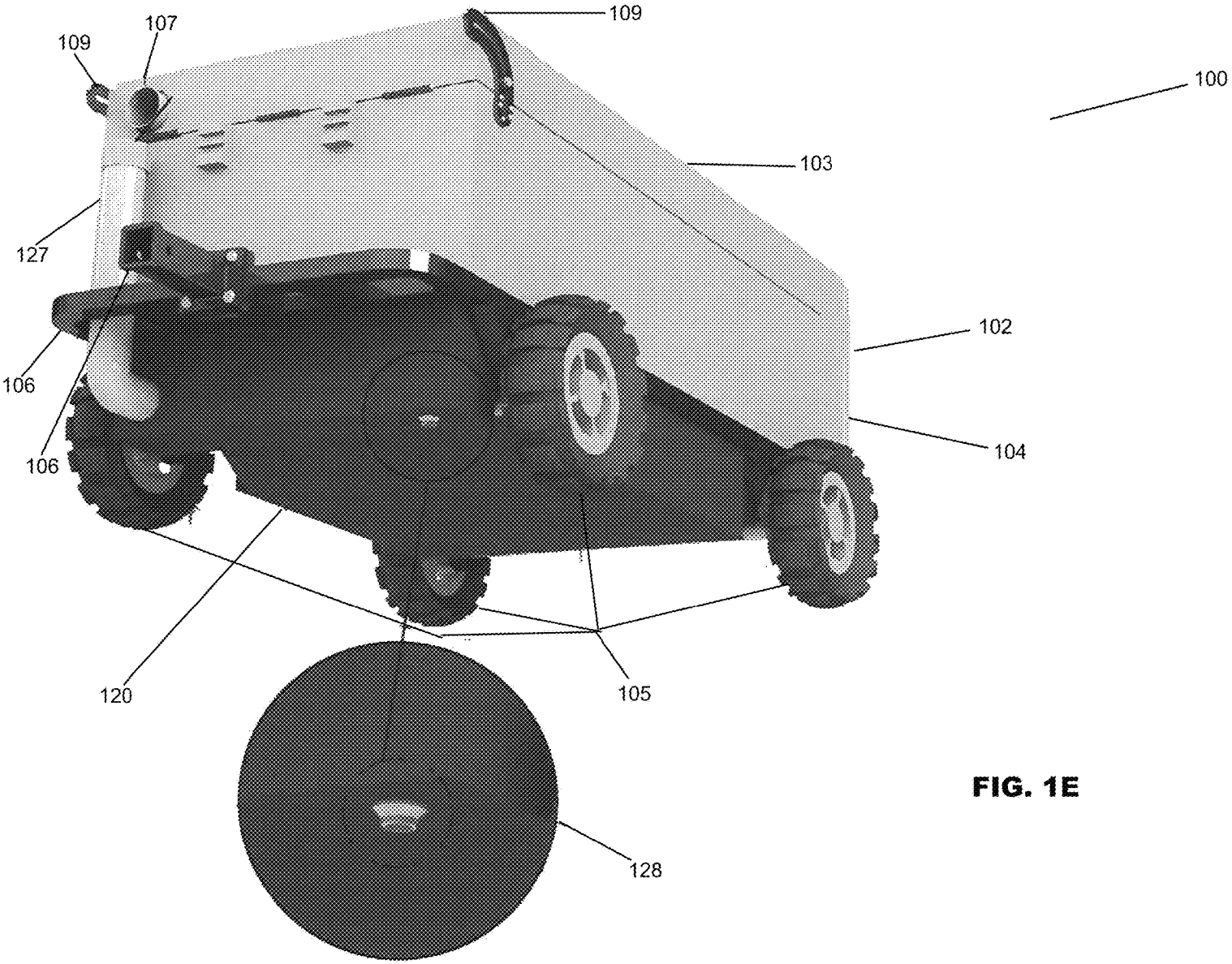
FIG. 1E is a rear perspective view of the portable shower device in accordance with an implementation of the invention.

Referring to FIGS. 1A-1E, the portable shower 100 can further include a base portion 120 that is formed on or fixedly secured to the housing 102 adjacent to the lower portion 104. The frame of the base portion 120 may be substantially rectangular; however the base portion 120 is not limited to any particular shape, and may be rectangular, square, round, octagonal, trapezoidal, hexagonal or oval, among other shapes. The base portion 120 may be constructed of a rigid material such as metal, plastic, fiberglass, or the like. The base portion 120 may be constructed of the same materials as the housing 102 and/or mimic the same shape of the housing 102. The base portion 120 may be generally hollow and may have an inlet (not shown), a conduit 127, a pump (not shown), a nozzle 128 (as shown in FIG. 1E), and one or more electrical connections 129 (as shown in FIGS. 1C & 1D).

The inlet of the base portion 120 is adapted to receive liquid from a liquid source outside the base portion 120 and direct the liquid to the conduit 127. The inlet may have one or more openings to allow liquid from outside the base portion 120 to enter the conduit 127. The inlet may be threaded so that it may easily couple to a hose for receipt of liquid. The conduit 127 is adapted to direct liquid received from the inlet to the channel 107 of the upper portion 103 of the housing 102. The inlet, the channel 107, the conduit 127, and the spout 108 may be in communication with one another so as to define a passage for liquid to travel therethrough. For example, the conduit 127 may be a pipe or the like that directs liquid received by the inlet to the channel 107, wherein the channel 107 directs the liquid received from the conduit 127 to the spout 108 for expulsion. The conduit 127 may extend distally from the base portion 120 in a substantially "L" shaped orientation.

Still referring to FIGS. 1A-1E, the pump (not shown) may be positioned near the inlet and adapted to draw liquid through the inlet into the conduit 127, and subsequently upstream through the channel 107 and out the spout 108 for expulsion. Upon the liquid being expelled from the spout 108, the outlet (not shown) may subsequently direct the liquid to outside the housing 102. In a preferred implementation, the outlet may be in communication with the nozzle 128 (as shown in FIG. 1E) positioned at the base portion 120 so as to form a duct for liquid to travel downstream therethrough and subsequently exit the housing 102. In one implementation the nozzle may be threaded so that it may be attached to a hose, which will grant a user greater control in directing the outflow of liquid from the housing 102.

Referring to FIGS. 1C and 1D, one or more electrical connections 129 are positioned at the base portion 120 and adapted to supply power to the pump (not shown). The one or more electrical connections 129 allow an electrical power cable attached to an external power source to supply power to the portable shower 100. More specifically, the one or more electrical connections 129 are in electrical communication with the pump, whereby an external power source may power the pump by connecting to the one or more electrical connections 129. The one or more electrical connections 129 may accept alternating current (AC) or direct current (DC) external power connectors.

In an alternative implementation, the base portion 120 of the portable shower 100 may further include a liquid heater (e.g., water heater). The liquid heater is adapted to regulate the temperature of liquid received by the inlet so that the user of the portable shower 100 can adjust the liquid temperature to their liking. The liquid heater may be a tankless liquid heater that operates on gas such as natural gas or propane gas. Alternatively, the liquid heater may be a tankless liquid heater that operates using electricity. In one implementation, as described above with respect to FIG. 1B, the one or more solar panels may be used as a power source to provide power to the pump to initiate upstream flow of liquid received by the inlet, or to provide power to the liquid heater to heat liquid as it passes through the channel 107 and the spout 108.

In an additional implementation, a power source (not shown) may be disposed within the base portion 120 of the portable shower 100 to provide power to the pump and/or the liquid heater. The power source may be an alternating current (AC) or direct current (DC) transformer. In another implementation, the power source 301 may be a battery that is removable and/or rechargeable. Further, the power source may be a rechargeable lithium-ion battery. The power source, the pump, or the liquid heater disposed within the base portion 120 of the portable shower 100 may be activated and controlled using a switch, such as a knob or button that is positioned on the housing 102 or the base portion 120 of the portable shower 100.

The portable shower 100 may further include various knobs, buttons, or indication lights that may correspond to various settings or functions of the portable shower 100. For example, the portable shower 100 may include variable liquid pressure, duration of water flow, or variable temperature settings that cause the pump to adjust the characteristics of liquid flow, or the liquid heater to adjust the temperature characteristics of the liquid. In another implementation, the housing 102 or base portion 120 of the portable shower 100, may include a display, for example an LED screen, an LCD screen, or another interactive device that communicates with the pump or the liquid heater to control various settings and functions of the portable shower 100.

In a further implementation, the portable shower 100 may include communication connection(s) that allows other devices to control the operation of the power source, the pump, or the liquid heater. Communication connection(s) may include, but are not limited to, a radio frequency transmitter/receiver, a Bluetooth transmitter/receiver, an infrared port, a Universal Serial Bus (USB) connection, or other interfaces for connecting the portable shower 100 to other devices. Example "other devices" include, but are not limited to, personal computers, hand-held or laptop devices, mobile devices (such as mobile phones, Personal Digital Assistants (PDAs), media players, and the like), consumer electronics, and the like.

Communication connection(s) may include a wired connection or a wireless connection. A wireless connection to a smartphone, tablet, or similar computerized device may include a computer application that communicates with the power source, the pump, or the liquid heater via the wireless connection. Communication connection(s) may transmit and/or receive communications that allow a user to control the activation of the power source, the pump, or the liquid heater and selectively adjust the characteristics of liquid flow, or the liquid heater to adjust the temperature characteristics of the liquid.

Still referring to FIGS. 1C and 1D, as previously mentioned, the upper portion 103 of the housing 102 is pivotally attached by a hinge 109 or the like so that the upper portion 103 may be selectively pivotable from either an open position (as shown in FIG. 1C) or a closed position (as shown in FIG. 1D). In the open position, the upper portion 103 of the housing 102 is preferably positioned perpendicular to the lower portion 104 of the housing 102. In operation, when the upper portion 103 of the housing 102 is positioned perpendicular to the lower portion 104 of the housing, the channel (107) (not shown) of the upper portion 103 and the conduit 127 of the lower portion 104 come into concentric communication with one another so as to define a passage for liquid to travel therethrough. Therefore, liquid drawn from the inlet may travel upstream through the conduit 127 and subsequently through the channel (107), wherein the channel (107) directs the liquid received from the conduit 127 to the spout 108 for expulsion. Liquid expelled from the spout 108, (or any other liquid source that causes liquid to enter the hollow interior of the lower portion 104) is directed to outside the housing 102 by the outlet (not shown).

Referring to FIGS. 1A, 1B and 1E, in one implementation, in the open position, an extent of the channel 107 may be threaded, and an extent of the conduit 127 may include a corresponding fastener adapted to fasten the conduit 127 to the channel 107 to maintain the connection and to create a liquid-tight seal to prevent leakage when the portable shower 100 is in use.

Figure 2A:
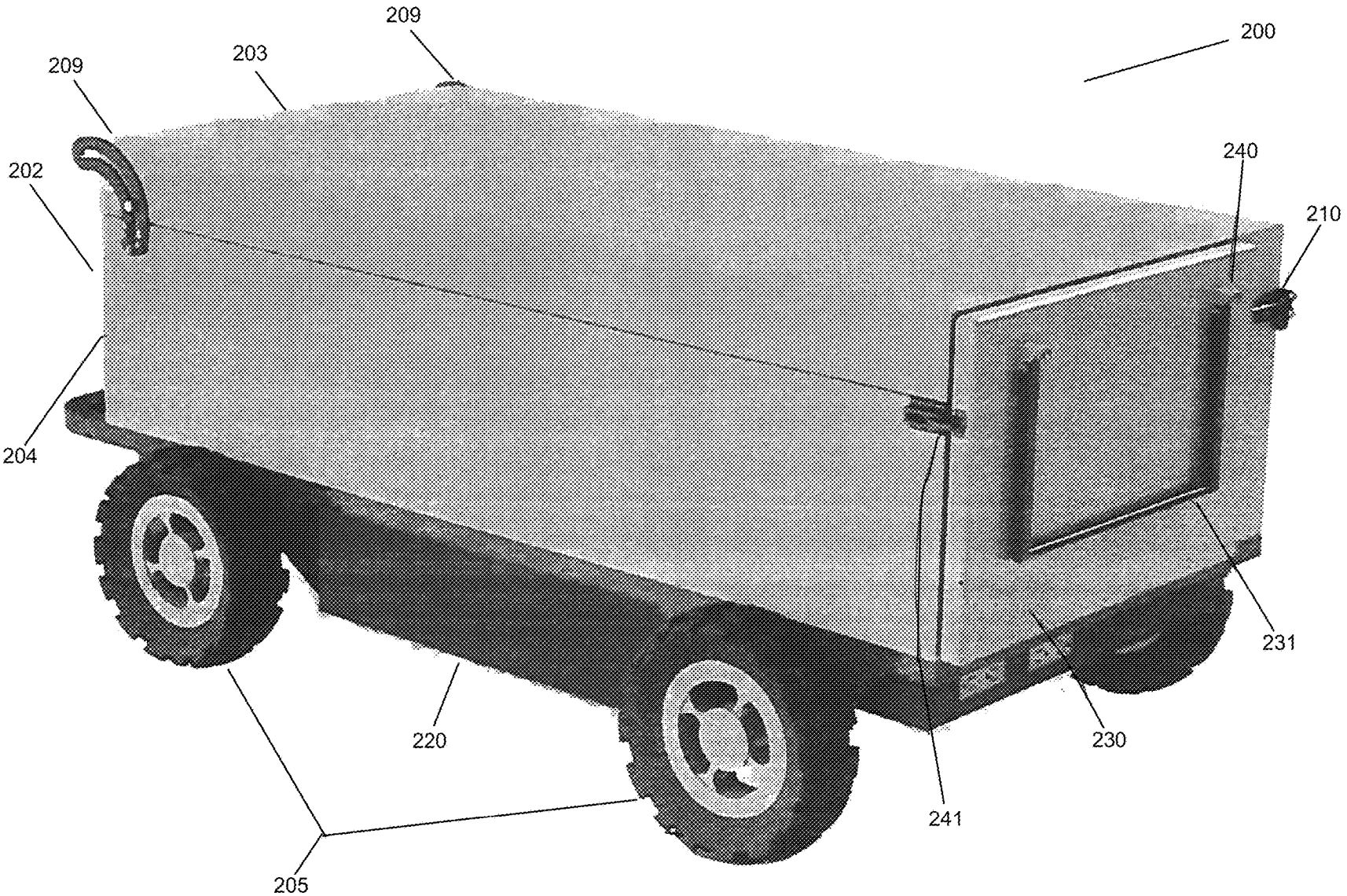
FIG. 2A is a perspective view of the portable shower device in accordance with an implementation of the invention.
Figure 2B:
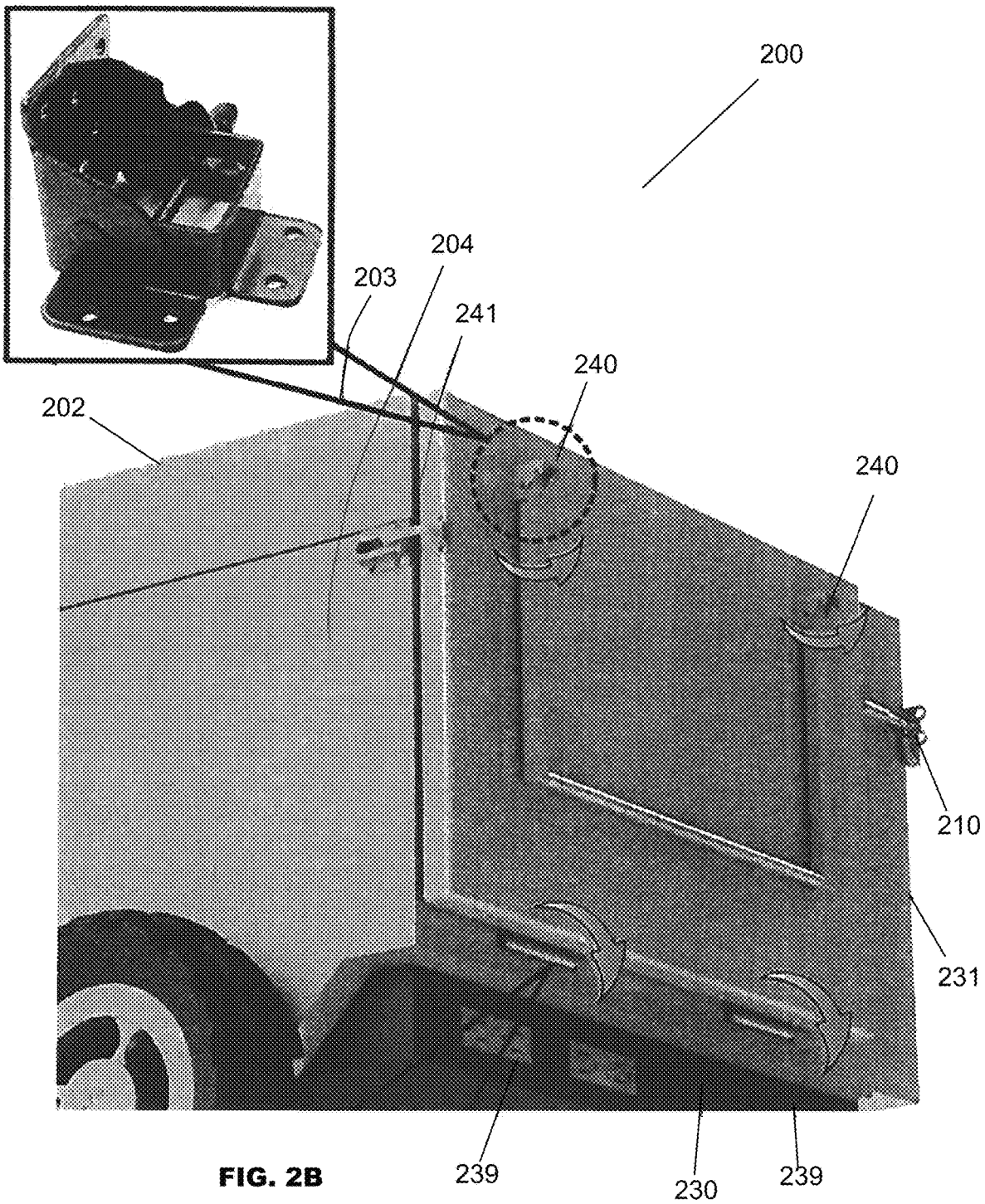
FIG. 2B-2C are perspective views of a platform in the stored position and the operative position, respectively, in accordance with an implementation of the invention.
Figure 2C:
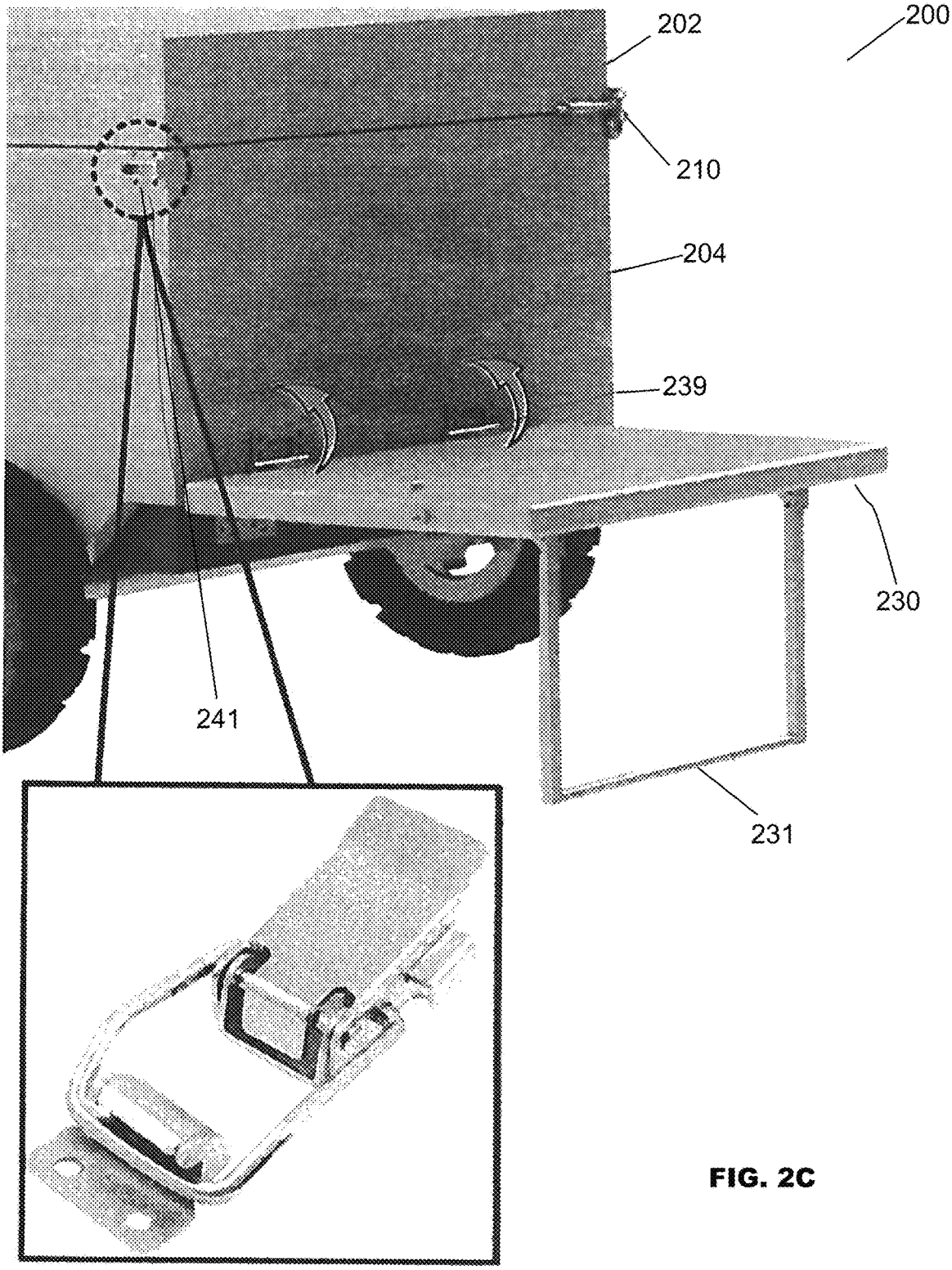
Figure 2D:
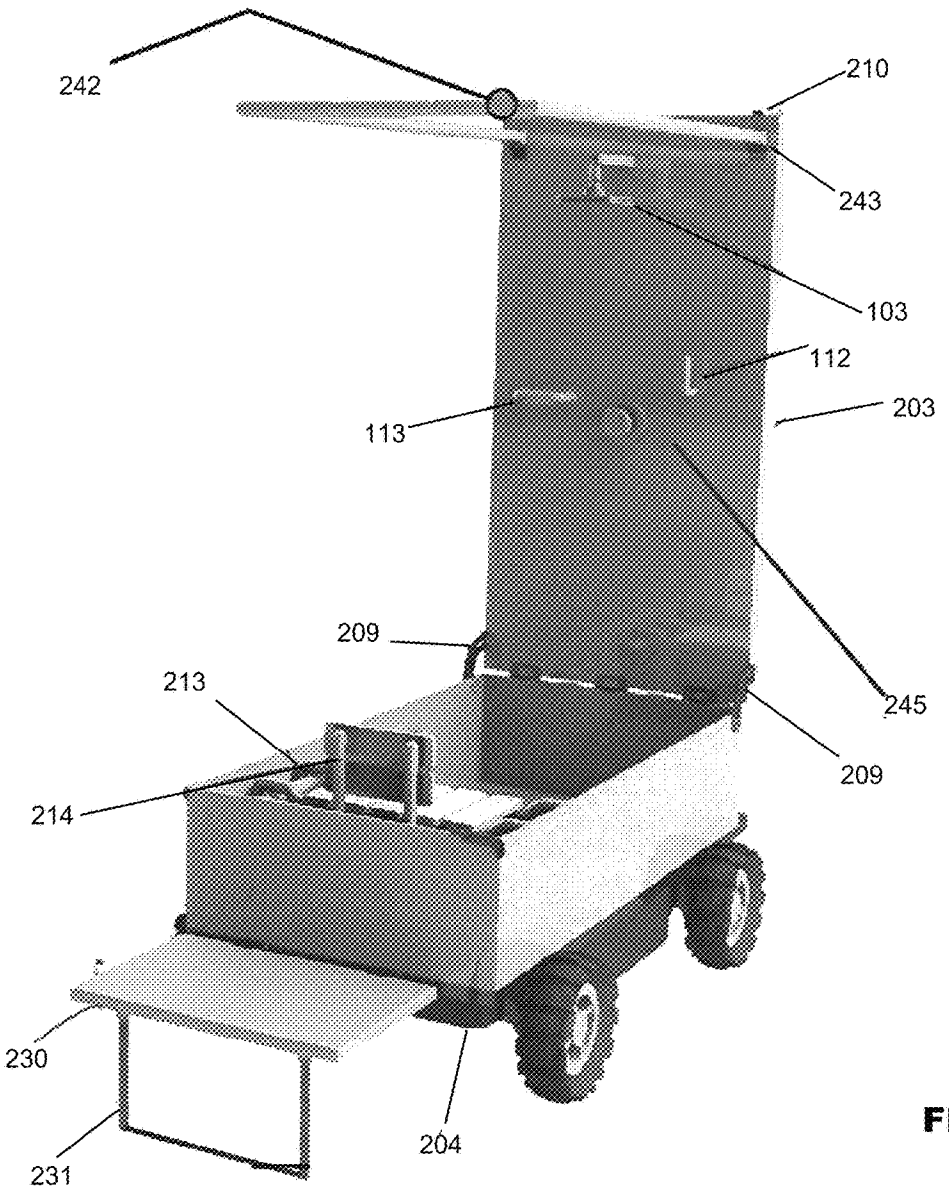
FIG. 2D is a perspective view of the portable shower device in the open position showing additional features in accordance with an implementation of the invention.

FIGS. 2A-2E illustrate an alternative implementation of the portable shower. Referring specifically to FIG. 2A, the portable shower 200 is shown including a housing 202 having, an upper portion 203, and a lower portion 204, and a platform 230. The housing 202 can include a wheel assembly 205 to facilitate movement of the portable shower 200. The upper portion 203 and the lower portion 204 of the housing 202 preferably have equal lengths and widths so that the housing 202 forms one unitary body when the portable shower 200 is in a closed position. The upper portion 203 of the housing 202 is preferably pivotally attached to the lower portion 204 of the housing 202. The upper portion 203 of the housing 202 is pivotally attached by a hinge 209 or the like so that the upper portion 203 may be selectively pivotable from either an open position (as shown in FIGS. 2D & 2F) or a closed position (as shown in FIG. 2A). In the open position, the upper portion 203 of the housing 202 is positioned perpendicular to the lower portion 204 of the housing 202. In the closed position, the upper portion 203 is positioned parallel adjacent to the lower portion 204 in sealing contact with the lower portion 204.

In this implementation, with respect to FIGS. 2A-2C, the housing 202 further includes a platform 230. The platform 230 is adapted to assist individuals with getting into and out of the lower portion 204 of the housing 202 when the portable shower 200 is in use (i.e. in the open position). An individual can further utilize the platform 230 to sit on, to support their weight, or to place objects on while the portable shower 200 is in use.

The shape of the platform 230 can be substantially rectangular; however, the platform 230 is not limited to any particular shape, and may be rectangular, square, or rounded, among other shapes and variations. Preferably, the platform 230 has a shape that substantially coincides with the shape of the lower portion 204 of the housing 202. The platform 230 can be fabricated with the same material as the housing 202, such as a rigid material like fiberglass, plastic, metal, or the like. The platform 230 is preferably fabricated from a rust-proof material, for example, a metal alloy such as stainless steel. In another implementation, the platform 230 may further include an anti-microbial and/or anti-bacterial coating. Additionally, the platform 230 may include a non-slip surface to prevent an individual from slipping when getting in or out of the lower portion 204 of the housing 202.

The platform 230 is pivotally attached to the housing 202 of the portable shower 200 at the exterior end of the housing 202 opposite the hinge 209. Specifically, the platform 230 is preferably pivotally attached to the lower portion 204 of the housing 202. In a preferred implementation, the surface area of the platform 230 takes up a substantial amount of surface area of the exterior end of the housing 202, but does not abut a lock 210. The platform 230 is pivotally attached by a hinge 239 or the like so that the platform 230 may be selectively pivotable from either a stored position (as shown in FIGS. 2A-2B) or an operative position (as shown in FIG. 2C).

The platform also includes a stand 231 that is pivotally attached to the platform 230 by a locking hinge 240. The locking hinge 240 is adapted to maintain the stand 231 in either the operative position or the stored position. Preferably, the locking hinge 240 would be utilized to temporarily maintain the stand 231 in the operative position so that a user cannot inadvertently force the stand 231 into the stored position. In another implementation, the locking hinge 240 may be used to maintain the stand 231 into the stored position so that a user cannot pivot the stand 231 without releasing the locking hinge 240.

The stand 231 may be comprised of a rigid frame. The stand 231 provides support to the platform 230 and maintains the position of the platform 230 in the operative position. In the stored position, as shown in FIGS. 2A-2B, the platform 230 is positioned parallel and adjacent to the exterior end of the housing 202 opposite the hinge 209, and the stand 231 is positioned parallel and adjacent to the platform 230. In the operative position, as shown in FIG. 2C, the platform 230 is positioned perpendicular to the housing 202, and the stand 231 is positioned perpendicular and adjacent to the platform 230, wherein the stand 231 is in contact with the ground (or other surface). In another implementation, a latch 241 may be used to maintain the platform 203 in the stored position so that a user cannot pivot the platform 203 without releasing the latch 241. The latch is preferably positioned at the periphery of the platform 230 and releasably attached to the exterior surface of the lower portion 204 adjacent to the periphery of the platform 230.

Referring to FIGS. 2D-2G, the upper portion 203 includes a channel 207 and a spout 208 to receive and expel liquid, respectively. The channel 207 and the spout 208 may be in communication with one another so as to define a passage for liquid to travel therethrough. The spout 208 may extend distally from an interior surface of the upper portion 203. The spout 208 may be an orifice having one or more apertures in which liquid may be expelled.

In one implementation, the interior surface of the upper portion 203 may also include one or more hangers 212 and/or one or more handles 213, wherein a wash cloth, towel, or the like may be hanged or a user may support their weight upon while using the portable shower 200. Further, the interior surface of the upper portion 203 may also include a caddy to hold common bathroom items such as soap, shampoo, conditioner, or the like.

In another implementation, the interior surface of the upper portion 203 includes a curtain frame 242. The curtain frame 242 is adapted to support a curtain 244 to provide privacy to a user and to prevent liquid from soaking the area around the housing 202 when the portable shower 200 is in use (i.e., in the open position). The curtain frame 242 is comprised of a substantially rigid frame made of one or more rods. The shape of the curtain frame 242 can be substantially rectangular; however, the curtain frame 242 is not limited to any particular shape, and may be rectangular, square, or rounded, among other shapes and variations. Preferably, the curtain frame 242 has a shape that substantially coincides with the shape of the upper portion 203 of the housing 202.

The curtain frame 242 can be fabricated with the same material as the housing 202, such as a rigid material like fiberglass, plastic, metal, or the like. The curtain frame 242 is preferably fabricated from a rust-proof material, for example, a metal alloy such as stainless steel. In another implementation, the curtain frame 242 may further include an anti-microbial and/or anti-bacterial coating.

Figure 2E:
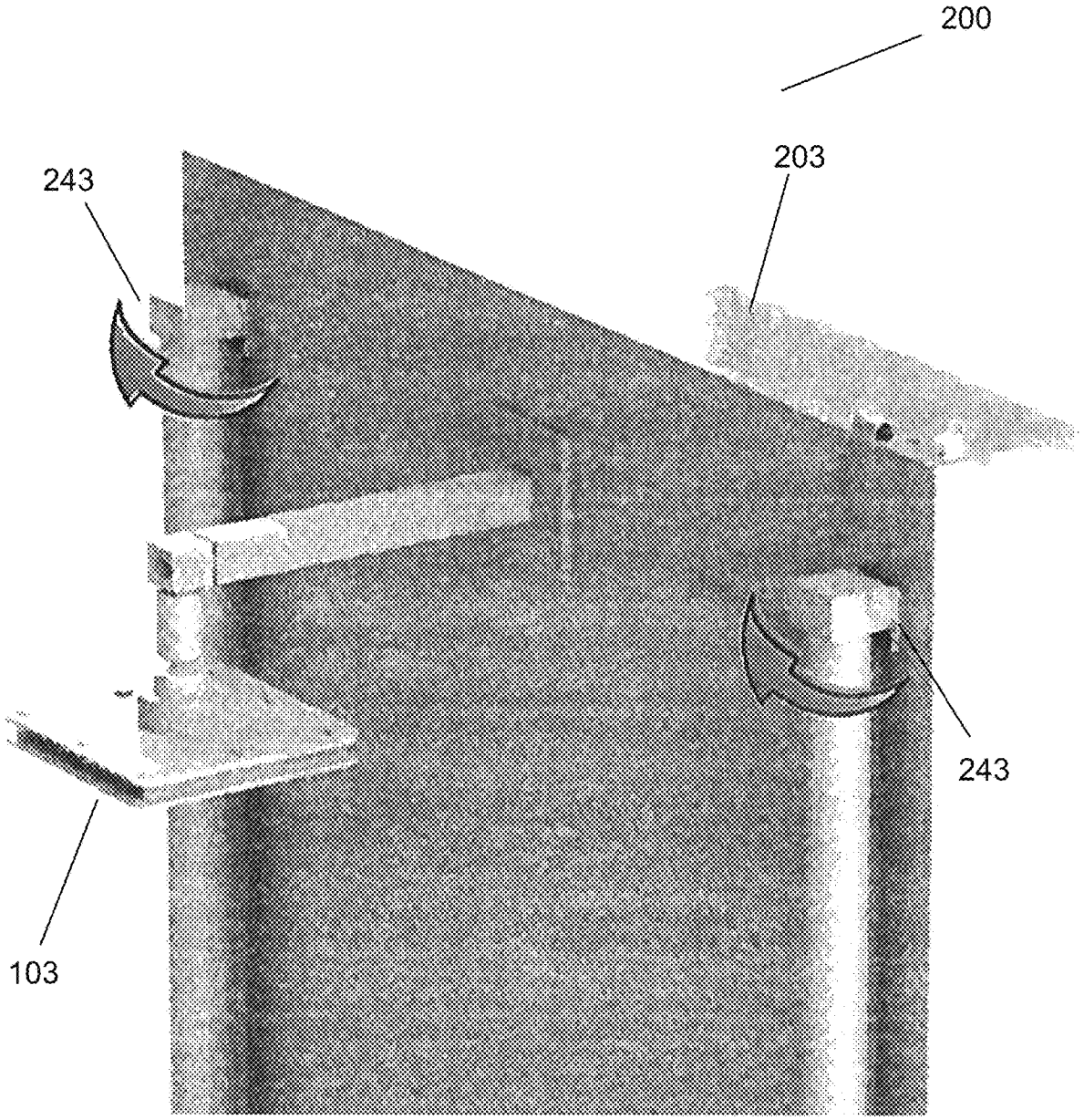
FIG. 2E is a perspective view a curtain frame in the non-use position in accordance with an implementation of the invention.
Figure 2F:
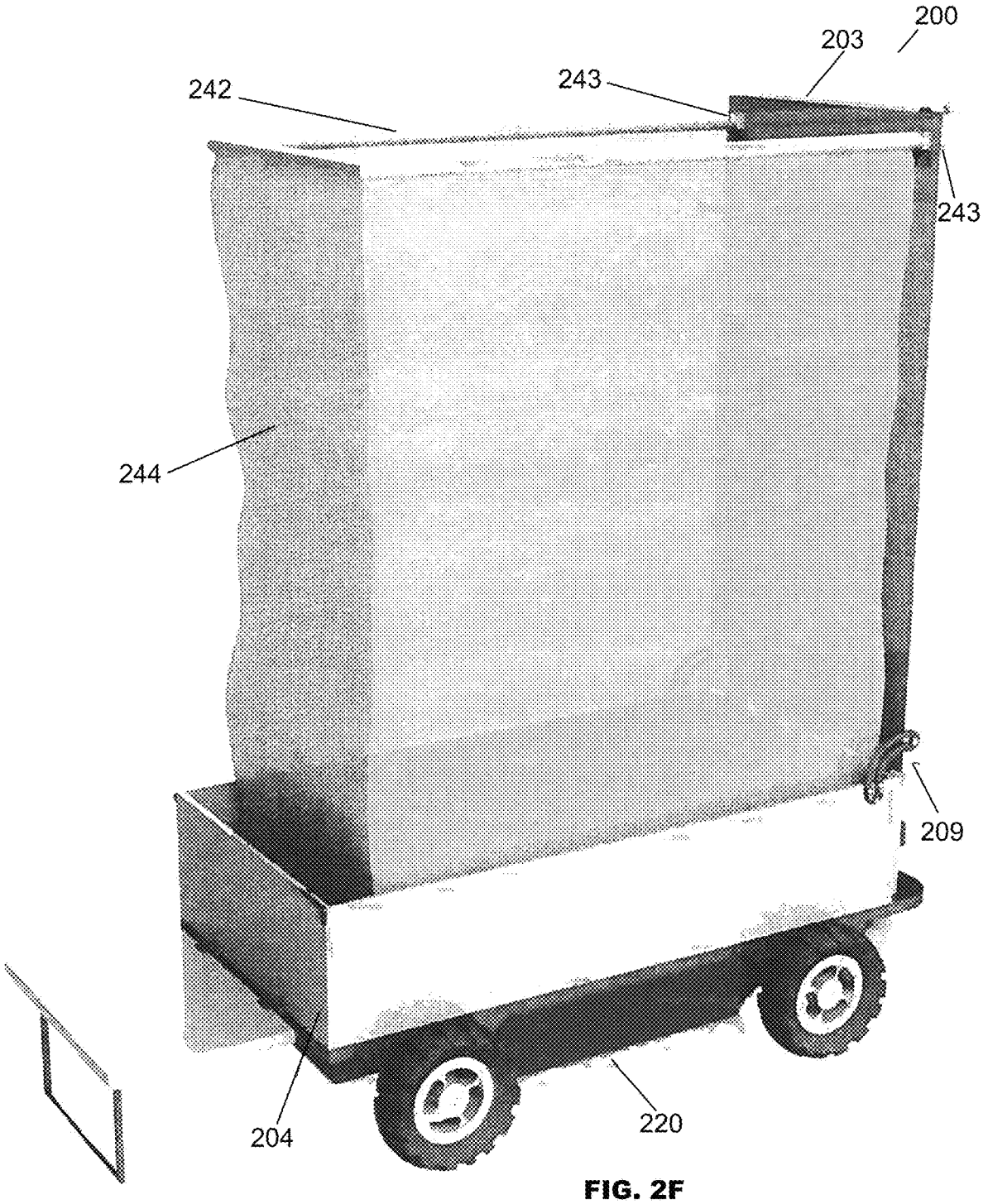
FIG. 2F-2G are various views of the curtain frame in the use position in accordance with an implementation of the invention.
Figure 2G:
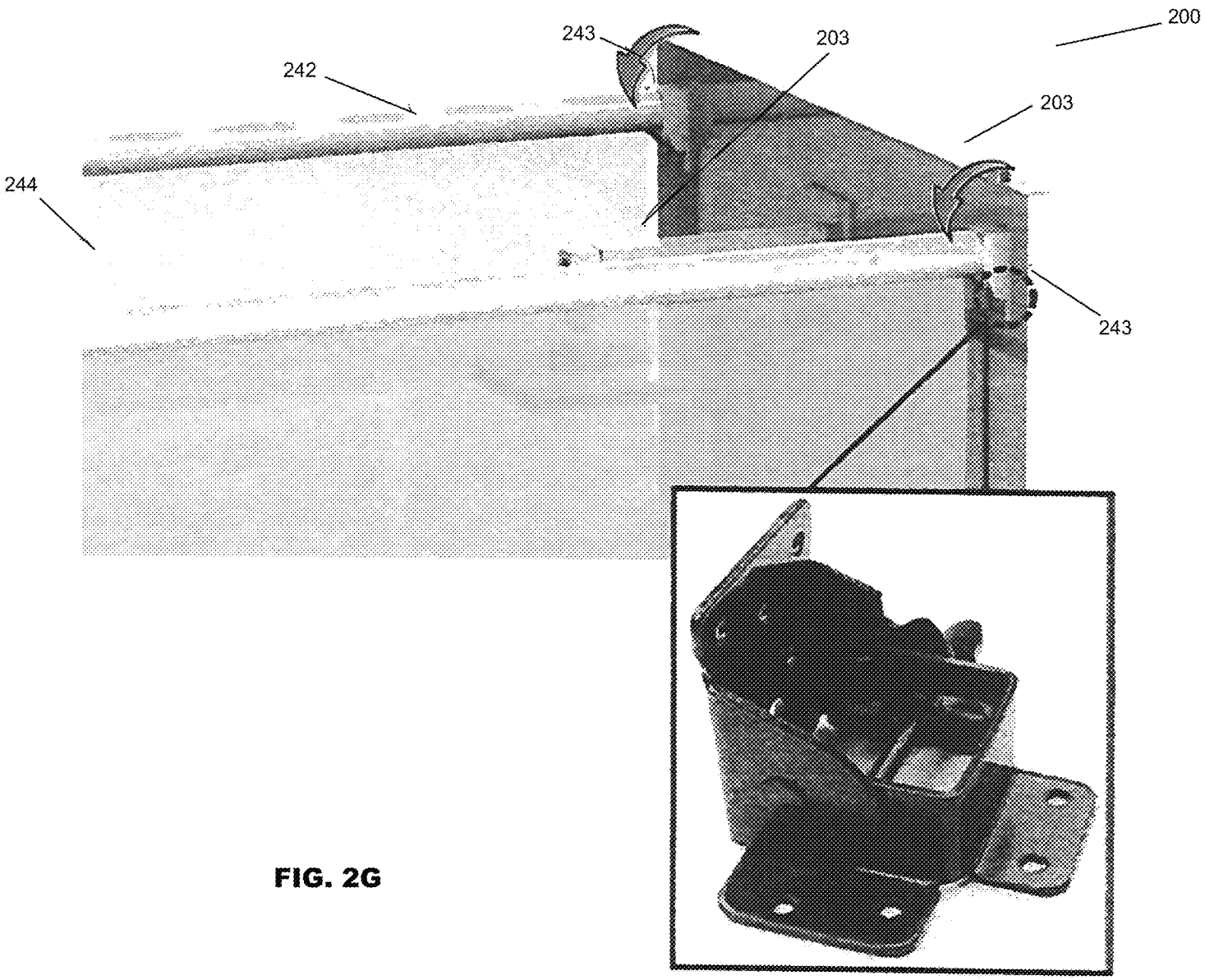

The curtain frame 242 is pivotally attached to the upper portion 203 of the housing 202 by a hinge 243 (as shown in FIG. 2G) or the like so that the curtain frame 242 may be selectively pivotable from either a non-use position (as shown in FIG. 2E) or a use position (as shown in FIGS. 2D, 2F, and 2G). In the non-use position, as shown in FIG. 2E, the curtain frame 242 is positioned parallel and adjacent to the interior surface of the upper portion 203. In the use position, as shown in FIGS. 2D, 2F and 2G, the curtain frame 242 is positioned perpendicular to the upper portion 202 and parallel to the lower portion 204.

Preferably, the hinge 243 would be utilized to temporarily maintain the curtain frame 242 in the use position so that a user cannot inadvertently force the curtain frame 242 into the non-use position. In another implementation, the hinge 243 may be used to maintain the curtain frame 242 into the non-use position so that a user cannot pivot the curtain frame 242 without releasing the hinge 243.

Referring to FIG. 2D, the lower portion 204 of the housing 202 has a generally hollow interior and an outlet (not shown) adapted to direct liquid to outside the housing 202. The lower portion 204 may also include a removable chair 214.

The outlet may be a drain having one or more apertures that receive liquid expelled from the spout 208 (or any other liquid source that causes liquid to enter the hollow interior of the lower portion 204), and subsequently direct the liquid to outside the housing 202. The outlet may be positioned at a floor of the lower portion 204. The outlet may be in communication with a nozzle positioned at a base portion so as to form a duct for liquid to travel therethrough and be expelled from the housing 202.

The portable shower 200 can further include a base portion 220 that is formed on or fixedly secured to the housing 202 adjacent to the lower portion 204. The base portion 220 may be generally hollow and may have an inlet, a conduit, a pump, a nozzle, and one or more electrical connections 229 (as shown in FIG. 2A-2C).

The inlet of the base portion 220 is adapted to receive liquid from a liquid source outside the base portion 220 and direct the liquid to the conduit 227. The conduit 227 is adapted to direct liquid received from the inlet to the channel 207 of the upper portion 203 of the housing 202. The inlet, the channel 207, the conduit 227, and the spout 208 may be in communication with one another so as to define a passage for liquid to travel therethrough.

The pump may be positioned near the inlet and adapted to draw liquid through the inlet into the conduit 227, and subsequently upstream through the channel 207 and out the spout 208 for expulsion. Upon the liquid being expelled from the spout 208, the outlet may subsequently direct the liquid to outside the housing 202. In a preferred implementation, the outlet may be in communication with the nozzle positioned at the base portion 220 so as to form a duct for liquid to travel downstream therethrough and subsequently exit the housing 202.

Referring to FIGS. 2A-2C, one or more electrical connections 229 are positioned at the base portion 220 and adapted to supply power to the pump (not shown). The one or more electrical connections 229 allow an electrical power cable attached to an external power source to supply power to the portable shower 200. More specifically, the one or more electrical connections 229 are in electrical communication with the pump, whereby an external power source may power the pump by connecting to the one or more electrical connections 229.

The base portion 220 of the portable shower 200 may further include a liquid heater (e.g., water heater). The liquid heater is adapted to regulate the temperature of liquid received by the inlet so that the user of the portable shower 200 can adjust the liquid temperature to their liking.

A power source may be disposed within the base portion 220 of the portable shower 200 to provide power to the pump and/or the liquid heater. Additionally, an external power source may provide power to the pump and/or liquid heater. The power source (internal or external), the pump, or the liquid heater disposed within the base portion 220 of the portable shower 200 may be activated and controlled using a switch, such as a knob 245 (as shown in FIG. 2D) or a button that is positioned on the housing 202 or the base portion 220 of the portable shower 200.

The portable shower 200 may further include various knobs 245, buttons, or indication lights that may correspond to various settings or functions of the portable shower 200. For example, the portable shower 200 may include variable liquid pressure, duration of water flow, or variable temperature settings that cause the pump to adjust the characteristics of liquid flow, or the liquid heater to adjust the temperature characteristics of the liquid. In another implementation, the housing 202 or base portion 220 of the portable shower 200, may include a display, for example an LED screen, an LCD screen, or another interactive device that communicates with the pump or the liquid heater to control various settings and functions of the portable shower 200.

Any reference in this specification to "one implementation," "an implementation," an "example implementation," etc., means that a particular feature, structure, or characteristic described in connection with the implementation is included in at least one implementation of the invention. The appearances of such phrases in various places in the specification are not necessarily referring to the same implementation. In addition, any elements or limitations of any invention or implementation thereof disclosed herein can be combined with any and/or all other elements or limitations (individually or in any combination) or any invention or implementation thereof disclosed herein, and all such combinations are contemplated with the scope of the invention without limitation thereto.

It should be understood that the examples and implementations described herein are for illustrative purposes only and that various modifications or changes in light thereof will be suggested to persons skilled in the art and are to be included within the spirit and purview of this application.

The invention claimed is:

1. A portable shower device, comprising:

a housing having an upper portion and a lower portion;

the upper portion having a surface, an exterior surface opposite the interior surface, a channel, and a spout extending distally from the interior surface of the upper portion;

the upper portion being pivotally attached to the lower portion and selectively pivotable from an open position or a closed position;

the lower portion including a hollow interior and an outlet adapted to direct liquid to outside the housing;

a base portion secured to the housing adjacent to the lower portion and having an inlet, a pump, a conduit, and one or more electrical connections;

the inlet adapted to receive liquid from outside the base portion;

the pump adapted to draw liquid received by the inlet to the conduit;

the conduit adapted to direct liquid received from the inlet to the channel of the upper portion of the housing;

the one or more electrical connections adapted to supply power to the pump;

wherein in the open position, the upper portion is positioned substantially perpendicular to the lower portion and the channel is in concentric communication and coupled with the conduit; and wherein in the closed position, the upper portion is disposed on top of the lower portion and the channel is uncoupled with the conduit by the upper portion being selectively pivotable with respect to the lower portion.

2. The portable shower device of claim 1, wherein in the closed position, the upper portion and the lower portion create a liquid-tight seal that restricts any liquid from exiting or entering the lower portion.

3. The portable shower device of claim 1, further comprising a wheel assembly disposed adjacent to the lower portion and the base portion.

4. The portable shower device of claim 1, further comprising a coupler mounted on the lower portion and adapted to facilitate transport or movement of the portable shower device.

5. The portable shower device of claim 1, wherein the base portion further comprises a nozzle adapted to expel liquid received from the outlet to outside the housing.

6. The portable shower device of claim 1, further comprising one or more solar panels attached to the upper portion and adapted to provide power to the pump.

7. The portable shower device of claim 1, further comprising a power source disposed within the base portion and adapted to provide power to the pump.

8. The portable shower device of claim 1, wherein the base portion further comprises a liquid heater adapted to regulate the temperature of liquid received by the inlet.

9. The portable shower device of claim 8, further comprising a knob adapted to enable a user to activate and operate the liquid heater or the pump.

10. The portable shower device of claim 1, wherein the lower portion further comprises one or more handles.

11. The portable shower device of claim 10, further comprising a chair having one or more hooks removably attached to the one or more handles of the lower portion.

12. The portable shower device of claim 1, wherein the upper portion further comprises one or more handles or one or more hangers.

13. The portable shower device of claim 1, wherein the spout is further connected to a shower head or a faucet.

14. The portable shower device of claim 1, further comprising a platform pivotally attached to the lower portion and selectively pivotable from a stored position or an operative position.

15. The portable shower device of claim 14, wherein the platform further comprises a stand pivotally attached to the platform that is selectively pivotable from a stored position or an operative position.

16. The portable shower device of claim 15, wherein in the stored position, the platform is positioned parallel and adjacent to the housing, and the stand is positioned parallel and adjacent to the platform.

17. The portable shower device of claim 15, wherein in the operative position, the platform is positioned perpendicular to the housing, and the stand is positioned perpendicular to the platform and is in contact with the ground.

18. The portable shower device of claim 1, further comprising a curtain frame pivotally attached to the upper portion and selectively pivotable from a non-use position or a use position.

19. The portable shower device of claim 18, wherein in the non-use position, the curtain frame is positioned parallel and adjacent to the upper portion.

20. The portable shower device of claim 18, wherein in the use position, the curtain frame is positioned perpendicular to the upper portion and parallel to the lower portion.

21. A portable shower device, comprising:

a housing having an upper portion and a lower portion;

the upper portion having an interior surface, an exterior surface opposite the interior surface, a channel, and a spout extending distally from the interior surface of the upper portion;

the upper portion being pivotally attached to the lower portion and selectively pivotable from an open position or a closed position;

the lower portion having sidewalls with an upper edge and surrounding and defining, with a floor of the lower portion, a hollow interior and an outlet adapted to direct liquid to outside the housing from the hollow interior;

a base portion secured to the housing adjacent to the lower portion and having a pump and a conduit, the pump adapted to direct a liquid to the conduit;

wherein in the open position, the upper portion is positioned substantially perpendicular to the lower portion and the channel is in concentric communication and coupled with the conduit; and wherein in the closed position, the upper portion is disposed on top of the upper edge of the sidewall of the lower portion in a liquid-tight seal and the channel is uncoupled with the conduit by the upper portion being selectively pivotable with respect to the lower portion.

22. A portable shower device, comprising:

a housing having an upper portion and a lower portion;

the upper portion having an interior surface, an exterior surface opposite the interior surface, a channel, and a spout extending distally from the interior surface of the upper portion;

the upper portion being pivotally attached to the lower portion and selectively pivotable from an open position or a closed position;

the lower portion having sidewalls with an upper edge and surrounding and defining, with a floor of the lower portion, a hollow interior and an outlet adapted to direct liquid to outside the housing from the hollow interior;

a base portion secured to the housing adjacent to the lower portion, a wheel assembly disposed adjacent to the lower portion and the base portion and operably configured to roll the housing whether the upper portion is in the open or the closed position, and having a pump and a conduit, the pump adapted to direct a liquid to the conduit;

wherein in the open position, the upper portion is positioned substantially perpendicular to the lower portion and the channel is in concentric communication and coupled with the conduit; and wherein in the closed position, the upper portion is disposed on top of the upper edge of the sidewall of the lower portion in a liquid-tight seal.

* * * * *